US006006690A

United States Patent [19]

Roy

[11] Patent Number: 6,006,690

[45] Date of Patent: Dec. 28, 1999

[54] MIXED-HULL INFLATABLE BOAT

[75] Inventor: Phillipe Roy, Le Bouscat, France

[73] Assignee: Zodiac International, Issy les Moulineaux, France

[21] Appl. No.: 08/881,043

[22] Filed: Jun. 25, 1997

[30] Foreign Application Priority Data

Nov. 27, 1996 [FR] France ..... 96 14530

[51] Int. Cl.[6] ..... B63B 7/08

[52] U.S. Cl. ..... 114/345

[58] Field of Search ..... 114/345

[56] References Cited

U.S. PATENT DOCUMENTS 4,942,838 7/1990 Boyer et al. ..... 114/345

FOREIGN PATENT DOCUMENTS 677643 1/1964 Canada ..... 114/345

274 359 A1 7/1988 European Pat. Off. ..... 114/345

0 583 226 A1 2/1994 European Pat. Off. ..... 114/345

1514509 2/1968 France .

1523150 5/1968 France .

2070272 9/1971 France .

2664205 1/1992 France .

2254052 9/1992 United Kingdom .

*Primary Examiner*—Sherman Basinger

*Attorney, Agent, or Firm*—Dean W. Russell; Kilpatrick Stockton LLP

[57] ABSTRACT

Mixed-hull inflatable boat, comprising a rigid submerged hull (2) surrounded at least bilaterally by inflatable buoyancy tubes (3), a transom (4) extending between the rear extremities of the two tubes (3) and the rigid submerged hull (2), characterised in that the rigid submerged hull (2) is extended to the rear, beyond the transom (4), by a flap (6) forming an integral part of said submerged hull (2).

9 Claims, 1 Drawing Sheet

MIXED-HULL INFLATABLE BOAT

FIELD OF THE INVENTION

The present invention relates to improvements made to mixed-hull inflatable boats, comprising a rigid hull surrounded at least on two sides by inflatable buoyancy tubes, a transom extending between the rear extremities of the two inflatable buoyancy tubes and the rigid hull.

BACKGROUND OF THE INVENTION

Certain conditions of travel and/or certain geometrical and structural configurations of a boat of the type indicated above lead to excessive bucking of the planing boat. In particular, boats of short length, loaded at the rear, have a significant tendency to buck. A boat which, when planing has a significant tendency to buck, hits the wave violently on the surface of its hull and, under the influence of repeated impacts, becomes difficult to steer accurately.

It is possible to cancel out or at least reduce the buck of a planing boat by fitting the rigid hull with at least one flap which extends the submerged hull to the rear beyond the transom: such a fitting, which remains structurally simple, is entirely satisfactory in stabilising the boat, in particular for boats of relatively short length which tend to buck easily.

However, the flap(s) is/are, in currently known implementations, constituted by one or more separate parts which are connected to the lower edge of the transom in such a way that they extend beyond it to the rear, in the approximate prolongation of the rigid submerged hull, and which are bolted onto the transom.

The visible joint between the flap(s) and the transom and also the visible bolts spoil the aesthetic appearance of this part of the boat, being all the more visible as it can be located at eye-level when a small boat is hauled on board a larger vessel for use as a lifeboat.

SUMMARY OF THE INVENTION

The main purpose of the invention is therefore to improve this fitting, which seems technically appropriate, in such a way that the presence of one or more rear flaps does not alter the aesthetic appearance of this part of the boat, while the implementation of this improvement must be simple and must not entail significantly increased difficulties or hull production costs.

For these purposes, a mixed-hull inflatable boat as mentioned in the preamble is essentially characterised in that, being fitted according to the invention, the rigid submerged hull is extended to the rear, beyond the transom, by a flap forming an integral part of said submerged hull.

In general, it is simpler to design a single flap extending along the full length of the submerged hull. The transom being fitted to support at least one outboard motor, the flap is designed so that at least its central portion is cut away to leave room for the propeller transmission shaft.

In practical terms, only the lower surface of the flap, in contact with the water, is functionally useful in obtaining the desired stabilising effect. For this reason, the upper surface of the flap is of no use vis-à-vis this function, and it is possible to design this upper surface in such a way that it assumes a separate function. In particular, it can be arranged for at least one lateral area of the flap to be designed, for its top portion, in the shape of steps forming a rear access ladder.

In the case of a boat comprising a rigid bridge hull at least in its rear portion, this bridge hull being securely connected by its lateral edges to the lateral edges of the rigid submerged hull, it is advantageous for the flap to be formed by the connection of a lower half-flap extending to the rear, integrally, the rigid submerged hull and an upper half-flap extending to the rear, integrally, the bridge hull. There results a simple constitution of the flap, and the manufacture of the two lower and upper half-flaps can easily be integrated into the overall manufacture, on the one hand of the submerged hull and, on the other hand, of the bridge hull, respectively. In particular as regards the bridge hull, it can be planned for this to at least partially incorporate the transom and for the upper half-flap to extend beyond the transom.

However, in this last case, there will be a difficulty in removing the monobloc part constituted by the bridge hull together with the transom from the mould, in that the inclination to the rear given to the transom, from the bottom to the top of the transom, is in a direction opposite to the undercut faces of the rest of the item. To overcome this problem simply and economically, and to avoid having recourse to a mould with removable parts, which is expensive, the central part of the transom, inclined towards the rear and on which the outboard motor is fixed, can be designed in such a way that it is constituted by a panel which is added and joined by fixing means to a transom base. This can be done in such a way that the fixing means (bolts) used to fix the transom to the bridge hull are camouflaged and given an aesthetically acceptable appearance.

BRIEF DESCRIPTION OF THE DRAWINGS

The invention will be better understood on reading the detailed description which follows of a preferred mode of implementation given purely as a non-limitative example. This description makes reference to the annexed diagram in which.

DETAILED DESCRIPTION

Figure 1:
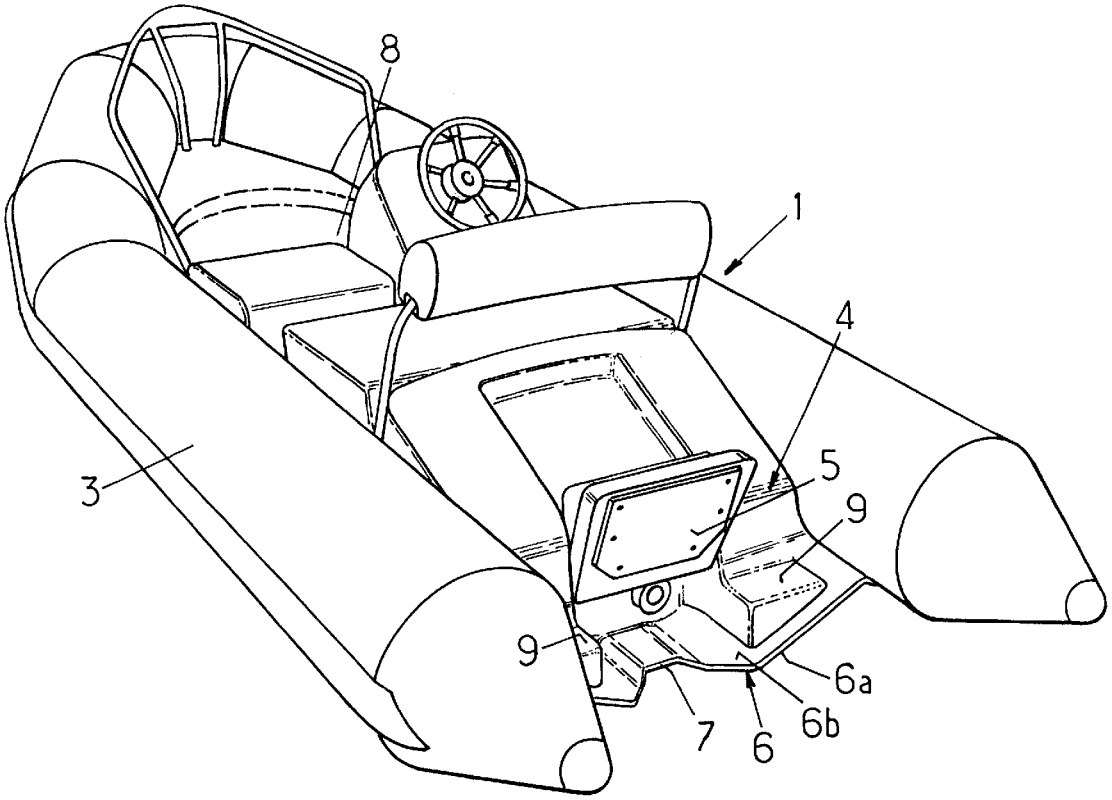
FIG. 1 is a three-quarter rear perspective view of a mixed-hull inflatable boat fitted according to the invention.
Figure 2:
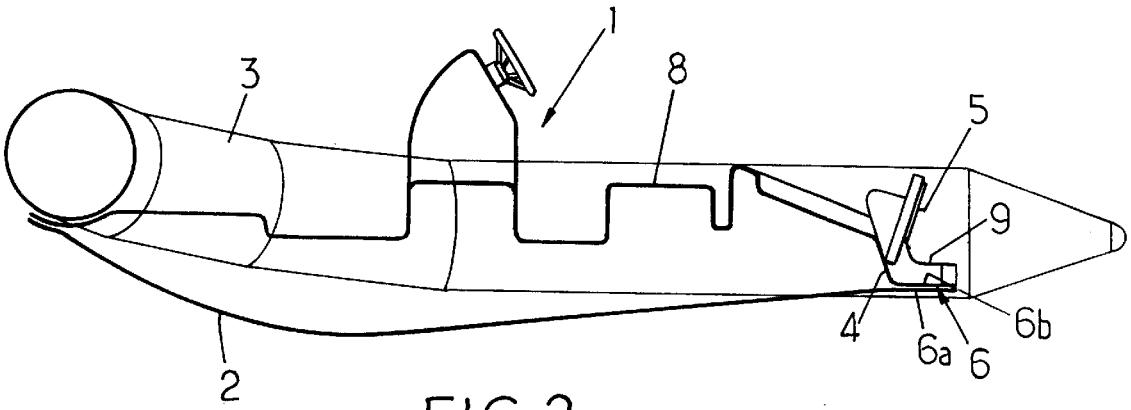
FIG. 2 is a very simplified longitudinal cross-section of a mode of implementation of FIG. 1.

In FIGS. 1 and 2, a mixed-hull inflatable boat, designated as a whole by reference 1, has a rigid submerged hull 2 (FIG. 2) surrounded bilaterally by inflatable buoyancy tubes 3. In the diagram, the two tubes extend to the front and join to form a single inflatable tube surrounding the rigid submerged hull to either side and to the front. A transom, generally designated by reference 4, extends transversally between the two rear extremities of the inflated tube 3 and the rear edge of the rigid submerged hull 2, to which it is securely connected in a watertight manner. The transom 4 is, at least over its central portion 5, fitted to support an outboard motor (not illustrated).

The general fitting of the boat 1 can be of any nature and is not of concern in the context of the invention: what is illustrated in this respect in FIGS. 1 and 2 is therefore purely illustrative (method for joining the tube to the submerged hull, fitting and position of the cockpit, number and location of seats, shape of the rear portion forming the transom or connected to the transom, type of accessories, etc.).

According to the invention, the rigid submerged hull 2 extends to the rear, beyond the transom 4, by at least one flat shape forming a flap 6 which is an integral part of said submerged hull. This flap 6 can extend in a unitary manner over the full width of the submerged hull as shown in FIG.

1, and it is then desirable for it to comprise in its centre a cutout 7 to accommodate the outboard motor transmission shaft; or it can be constituted in the form of two flap parts situated laterally either side of a central cutout provided for the said outboard motor column.

The provisions of the invention find a particularly useful application in certain types of mixed-hull inflatable boats in which, as shown in FIGS. 1 and 2, the rigid structure is constituted by the rigid submerged hull 2 below and a rigid bridge hull 8 above (of a complex shape including, cast from a mould, the cockpit block, seat bases, lockers, etc.), which are securely connected to each other by their peripheral edges along which the inflatable tube 3 is then attached.

In this case, the rigid submerged hull 2 has a rear extension forming a lower half-flap 6*a* and the bridge hull 8 (incorporating the transom 4) has a rear extension beyond the transom 4, forming an upper half-flap 6*b*; joining and connecting the half-flaps 6*a* and 6*b* forms the full flap 6.

An advantage of this fitting is that the two half-flaps 6*a* and 6*b* have a smooth visible surface with a perfect finish so that the two surfaces, lower and upper, of the full flap 6 are aesthetically pleasing.

Another advantage resides in the fact that only the lower surface of the flap 6 is functionally useful in stabilising the boat. On the other hand, the upper surface, which plays no role in this function, can be shaped in any desirable way to provide a different function. For example, as shown in the diagram, the two lateral areas of the upper flap 6*b* are shaped as steps 9, forming a rear access ladder. Naturally, such a fitting could be planned (although technically less straightforward) in the case where flap 6 is of a monobloc structure.

However, there may be a problem removing the bridge hull from the mould. Indeed, so that it can be fitted with an outboard motor equipped with standardised fixing means, at least the central portion 5 of the transom must be inclined, from bottom to top, toward the rear, that is, in a direction opposite to that of the undercut surfaces of the other parts of the bridge hull: thus, a unitary bridge hull, incorporating the central portion 5 of the transom, could not be removed from the mould in a simple manner, and it would be necessary to have recourse to a mould with removable parts.

To avoid this costly solution, it is planned to constitute the central part 5 of the transom in the form of a separate part, placed and joined (by bolting for example) to a base moulded together with the rest of the transom. It is then easy to shape the parts in order to camouflage the fixing bolts so that the aesthetic appearance of the rear part of the boat is not affected by this type of assembly.

As it will be understood and as already results from the above, the invention is in no way limited to the methods of use and execution which have been more particularly envisaged; on the contrary, it embraces all variants.

I claim:

1. A mixed-hull inflatable boat, comprising a rigid submerged hull which is surrounded at least bilaterally by inflatable buoyancy tubes, a transom which extends between the rear ends of the tubes and the rigid submerged hull and which is adapted to support at least one outboard motor, and a rigid bridge hull having lateral edges securely connected to lateral edges of the rigid submerged hull, the rigid submerged hull extending to the rear beyond the transom by a flap, wherein the flap is formed by the connection of a lower half-flap extending to the rear, integrally, from the rigid submerged hull and an upper half-flap extending to the rear, integrally, from the bridge hull.

2. A boat according to claim 1, wherein the bridge hull incorporates at least partially the transom and the upper half-flap extends beyond the transom.

3. A boat according to claim 2, wherein a central part of the transom, which is inclined toward the rear and to which an outboard motor is fixed, is constituted by a panel securely attached to a transom base using fixing means.

4. A boat according to claim 1, wherein the flap is cut away at least in its central area to accommodate a propeller transmission column.

5. A boat according to claim 1, wherein at least one lateral area of the flap is shaped for its upper part in the shape of steps forming a rear access ladder.

6. An inflatable boat provided with a transom and comprising:

a. a bridge hull having a rear from which an integrally-formed upper flap portion extends at least partially beyond the transom; and b. a submerged hull (i) connected to the bridge hull and (ii) having a rear from which an integrally-formed lower flap portion extends at least partially beyond the transom, the upper and lower flap portions being joined to form a flap extending at least partially beyond the transom and adapted to assist in stabilizing the boat in use.

7. A mixed-hull inflatable boat comprising:

a. a rigid submerged hull having a rear portion;

b. a plurality of inflatable buoyancy tubes at least bilaterally surrounding the rigid submerged hull, each inflatable buoyancy tube having a rear extremity;

c. a transom:

i. extending transversely between the rear extremities of the inflatable buoyancy tubes, ii. connected to the rear portion of the rigid submerged hull, and iii. having a central portion fitted to support an outboard motor;

d. means, comprising a lower flap segment connected to the rigid submerged hull so as to extend beyond the rear portion thereof and at least partially beyond the transom, for assisting in stabilizing the boat in use;

e. a rigid bridge hull connected to the submerged hull; and f. an upper flap segment connected to the rigid bridge hull extending at least partially beyond the transom and joined to the lower flap segment.

8. A boat according to claim 7 in which the lower flap segment is flat and integrally connected to the rigid submerged hull.

9. A boat according to claim 8 in which the upper flap segment is integrally connected to the rigid bridge hull.

* * * * *